US006095917A

United States Patent [19]

Utsuki

[11] Patent Number: 6,095,917

[45] Date of Patent: Aug. 1, 2000

[54] AIR-SHOWER APPARATUS AND SEMICONDUCTOR WAFER PROCESSING METHOD

[75] Inventor: Tomokatsu Utsuki, Tokyo, Japan

[73] Assignee: Oki Electric Industry Co., Ltd., Tokyo, Japan

[21] Appl. No.: 09/280,651

[22] Filed: Mar. 29, 1999

[30] Foreign Application Priority Data

Jun. 3, 1998 [JP] Japan ..... 10-154999

[51] Int. Cl.[7] ..... B01L 1/04

[52] U.S. Cl. ..... 454/187

[58] Field of Search ..... 454/187; 15/301

[56] References Cited

U.S. PATENT DOCUMENTS 4,581,986 4/1986 Conklin et al. ..... 454/187

4,838,150 6/1989 Suzuki et al. ..... 454/187

5,562,539 10/1996 Hashimoto et al. ..... 454/187

*Primary Examiner*—Denise L. Ferensic

*Assistant Examiner*—Jiping Lu

*Attorney, Agent, or Firm*—Rabin & Champagne, PC

[57] ABSTRACT

An air shower apparatus of this invention includes an air shower room, a ring member provided within the air shower room and having a plurality of air blowing outlets for blowing clean air in a direction of a chamber entrant to remove dust particles, and a vertical drive unit for moving the ring member up and down in such a manner that clean air is blown towards the chamber entrant from head to toe. The plurality of air blowing outlets are arranged at prescribed intervals along the inner periphery surface of the ring member in such a manner as to surround the chamber entrant.

7 Claims, 12 Drawing Sheets

AIR-SHOWER APPARATUS AND SEMICONDUCTOR WAFER PROCESSING METHOD

BACKGROUND OF THE INVENTION

1. Field of the Invention

The present invention relates to technology for an air shower apparatus to be installed at an entrance or the like to a clean room at, for example, a semiconductor manufacturing plant.

2. Description of Related Art

Conventionally, an air shower apparatus is installed at an entrance to a clean room in order to maintain the clean atmosphere required for a clean room for manufacturing semiconductors and electronic parts, etc.

All people who enter the clean room enter an air shower chamber S in order to remove dust particles attached to clothing etc. Upon entering the chamber, a turbo fan operates and clean air is blown out of an air blower. The flow of clean air first passes through a pre-filter, is pressurized by the turbo fan, passes through a high-performance dust collecting filter and is then blown out from the air blower as a high-speed flow of clean air. The clean air that is blown out then removes the dust particles attached to a person's clothes etc. and is again sucked back into circulation at the pre-filter.

However, the following problems exist with related air shower apparatus.

Firstly, as the air blower is fixed, the clean air does not thoroughly collide with people's bodies and the efficiency with which dust particles are removed is poor.

Secondly, as the air is only blown out in a fixed direction towards the person, air including clean air blown out from the air blower and air with dust particles removed flows as convection currents within the air shower and dust particles therefore become re-attached to clothes etc.

Thirdly, there is also the fear that when high-speed air is being blown out from the air blower, as the air shower chamber is at positive pressure with respect to the atmosphere within the clean room, air contaminated with dust particles will leak into the clean room from gaps between a door, etc.

SUMMARY OF THE INVENTION

In order to take into consideration the aforementioned points, the present invention provides an air shower apparatus capable of improving the efficiency with which dust particles are removed, preventing dust particles from becoming re-attached and preventing air mixed with dust particles from leaking into a clean room.

In order to resolve the above problems, an air shower apparatus of this invention therefore comprises an air shower room, a ring member provided within the air shower room and having a plurality of air blowing outlets for blowing clean air in a direction of a chamber entrant to remove dust particles, and a vertical drive unit for moving the ring member up and down in such a manner that clean air is blown towards the chamber entrant from head to toe. The plurality of air blowing outlets are arranged at prescribed intervals along the inner periphery surface of the ring member in such a manner as to surround the chamber entrant.

BRIEF DESCRIPTION OF THE DRAWINGS

While the specification concludes with claims particularly pointing out and distinctly claiming the subject matter which is regarded as the invention, it is believed that the invention, the objects, features of the invention and further objects, features and advantages thereof will be better understood from the following description taken in connection with the accompanying drawings in which:

DETAILED DESCRIPTION OF THE PREFERRED EMBODIMENTS

The following is a description based on the drawings of the embodiments of the present invention.

First Embodiment

Figure 1:
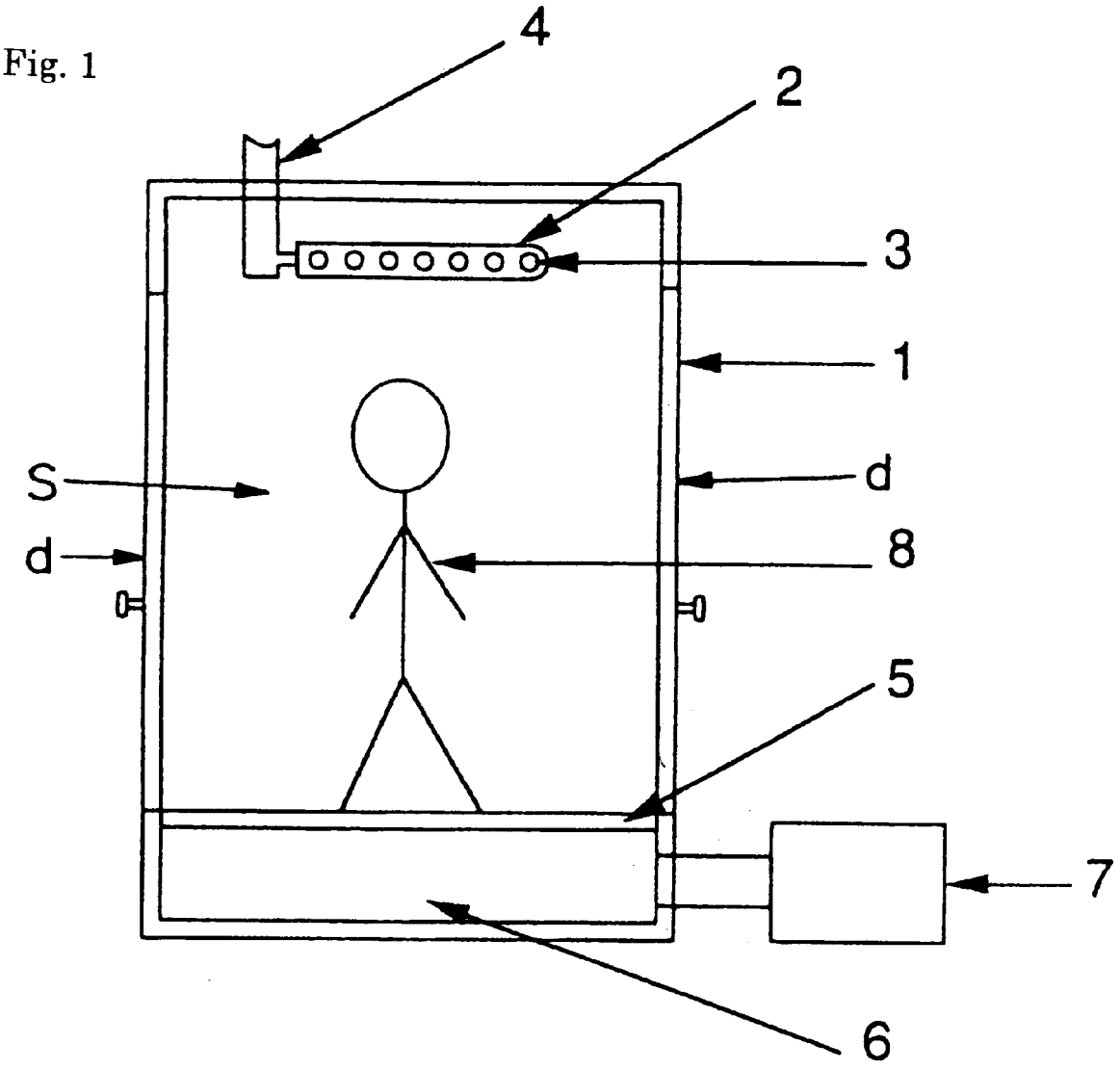
FIG. 1 is a cut-away view of an air shower apparatus relating to a first embodiment of the present invention.
Figure 2:
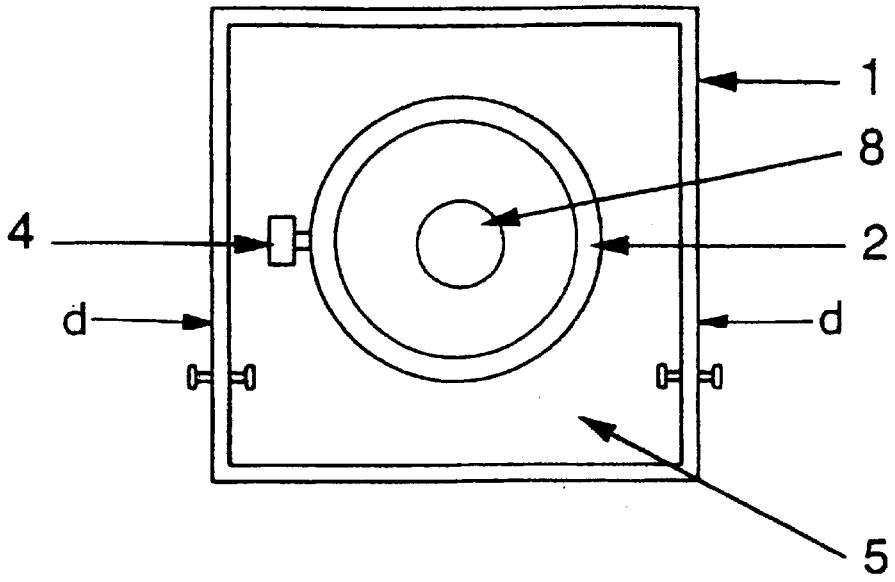
FIG. 2 is a plan view of the air shower apparatus relating to the first embodiment of the present invention.
Figure 3:
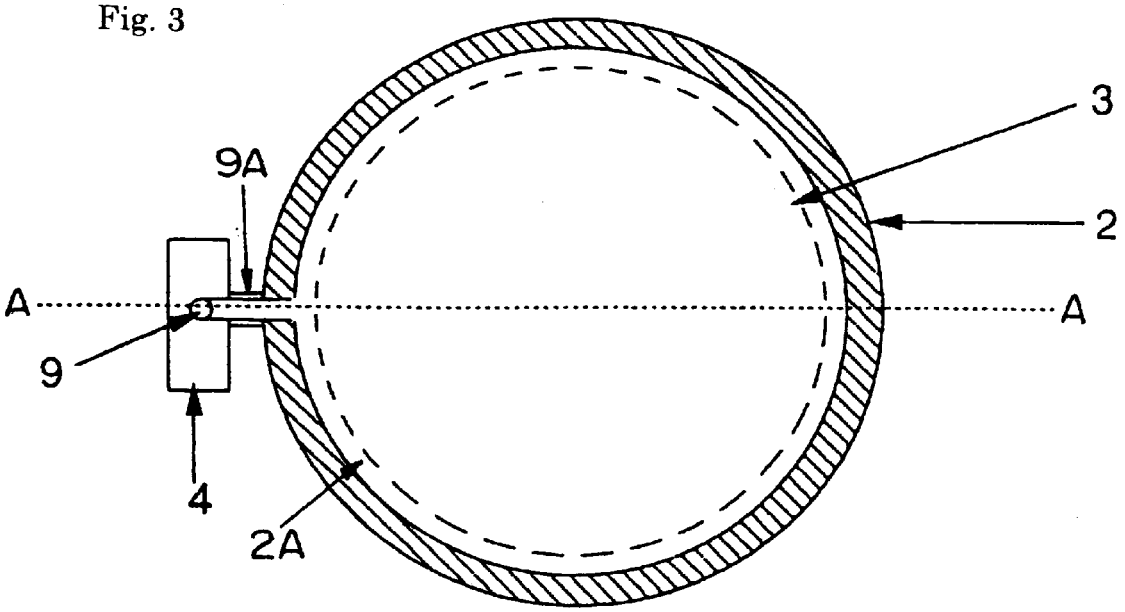
FIG. 3 is an enlarged view of a ring member relating to the first embodiment of the present invention.

FIG. 1 is a cut-away view of an air shower apparatus relating to a first embodiment of the present invention. FIG. 2 is a view from above of the air shower apparatus relating to the first embodiment. FIG. 3 is an enlarged view of a ring member thereof and FIG. 4 is a cut-away view taken along line A—A of FIG. 3.

In the above drawings, numeral 1 represents an air shower unit body, with an air shower chamber S formed therein. A movable ring member 2 having a large number of clean air blowing outlets 3 is arranged horizontally at a ceiling side of the air shower chamber S.

Figure 4:
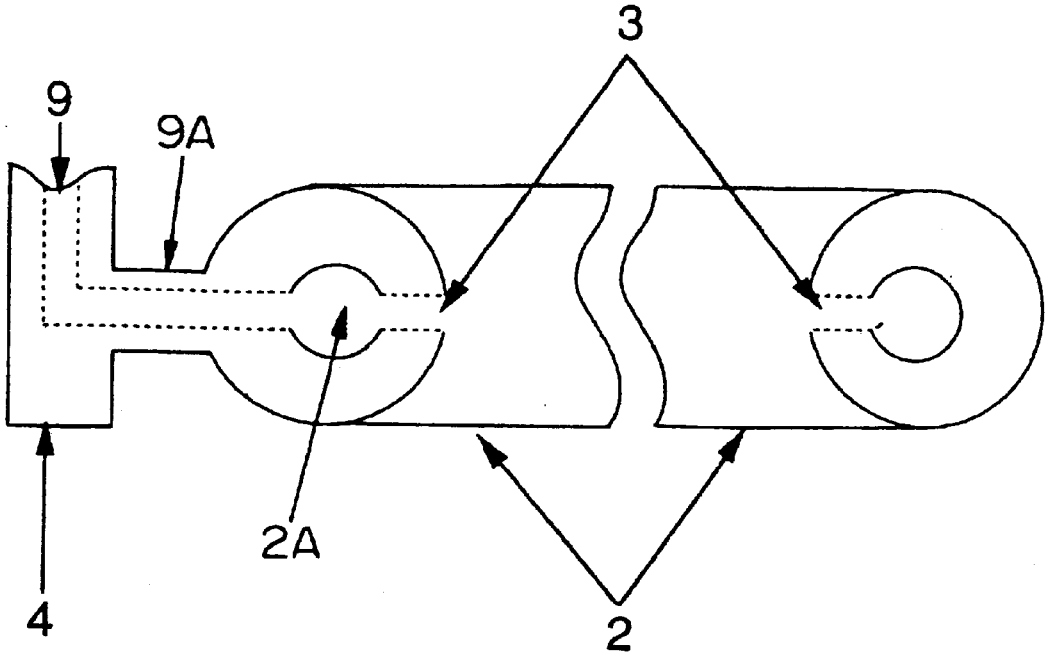
FIG. 4 is a cut-away view taken along line A—A of FIG. 3 showing a ring member relating to the first embodiment of the present invention.

As shown in FIG. 3 and FIG. 4, this ring member 2 has a clean air path 2A within an overall cylindrical ring shape and the air blowing outlets 3 communicate with the path 2A. The air blowing outlets 3 are open at the inner periphery of the ring member 2 in the horizontal direction and are arranged so as to be spaced in the along of the periphery of the ring member 2.

The ring member 2 is supported by a vertical drive shaft 4 so as to be capable of being moved up and down within the air shower chamber S. An air supply path 9 is present within the vertical drive shaft 4 and communicates with the path 2A via a connector 9A for the vertical drive shaft 4 and the ring member 2.

The internal diameter of the ring member 2 is of a size capable of surrounding the periphery of a person (body) entering the chamber, as shown in FIG. 2, so that all of the air blown out of the clean air blowing outlets 3 flows in the direction of the chamber entrant 8.

A pre-filter 5 is arranged at the lower part of the air shower chamber S and an air expulsion buffer chamber 6 is provided below the pre-filter 5. Although not explicitly shown, a reinforcing material such as a grating doubling as a floor surface on which a person that is to enter the chamber can stand is incorporated into the pre-filter 5 in order to protect the pre-filter 5.

An air expulsion unit 7 is connected to the air expulsion buffer chamber 6 in order to maintain negative pressure at the air expulsion buffer chamber 6. As a result, air within the air shower chamber S is sucked into the pre-filter 5, passes through the air expulsion buffer chamber 6 and is expelled to outside.

According to this embodiment, when a person enters the air shower chamber S and stands at a prescribed position, the ring member 2 is lowered down by the vertical drive shaft 4 while at the same time, clean air is blown out at high speed from the clean air blowing outlets 3. The ring member 2 is then sequentially lowered down to the vicinity of the persons feet. Dust particles are therefore removed from the outer periphery of the chamber entrant 8 360 degrees all round from head to toe. Contaminated air including removed dust particles then passes through the pre-filter 5 in order to catch dust particles, flows to the air expulsion buffer chamber 6 and is expelled to outside by the air expulsion unit 7.

The clean air is therefore directed all over the chamber entrant 8 and the effectiveness with which dust particles are removed is dramatically improved. Further, as clean air blowing outlets 3 are provided at the ring member 2 of a size capable of surrounding the periphery of the chamber entrant 8 and are made to communicate with the inner clean air path 2A, in addition to each of the clean air blowing outlets 3 being simultaneously made to move vertically, each of the clean air blowing outlets 3 and the ring member 2 do not have to be provided independently and an accompanying simplification of the structure can therefore be achieved.

Further, the flow of air within the air shower chamber S can be forcibly made to go downwards using the air expulsion buffer chamber 6 and the air expulsion unit 7. As a result, the air shower chamber S is put at negative pressure and air including dust particles within the air shower chamber S is prevented from escaping to neighboring clean rooms etc. from gaps between, for example, a door d.

Second Embodiment

Figure 5:
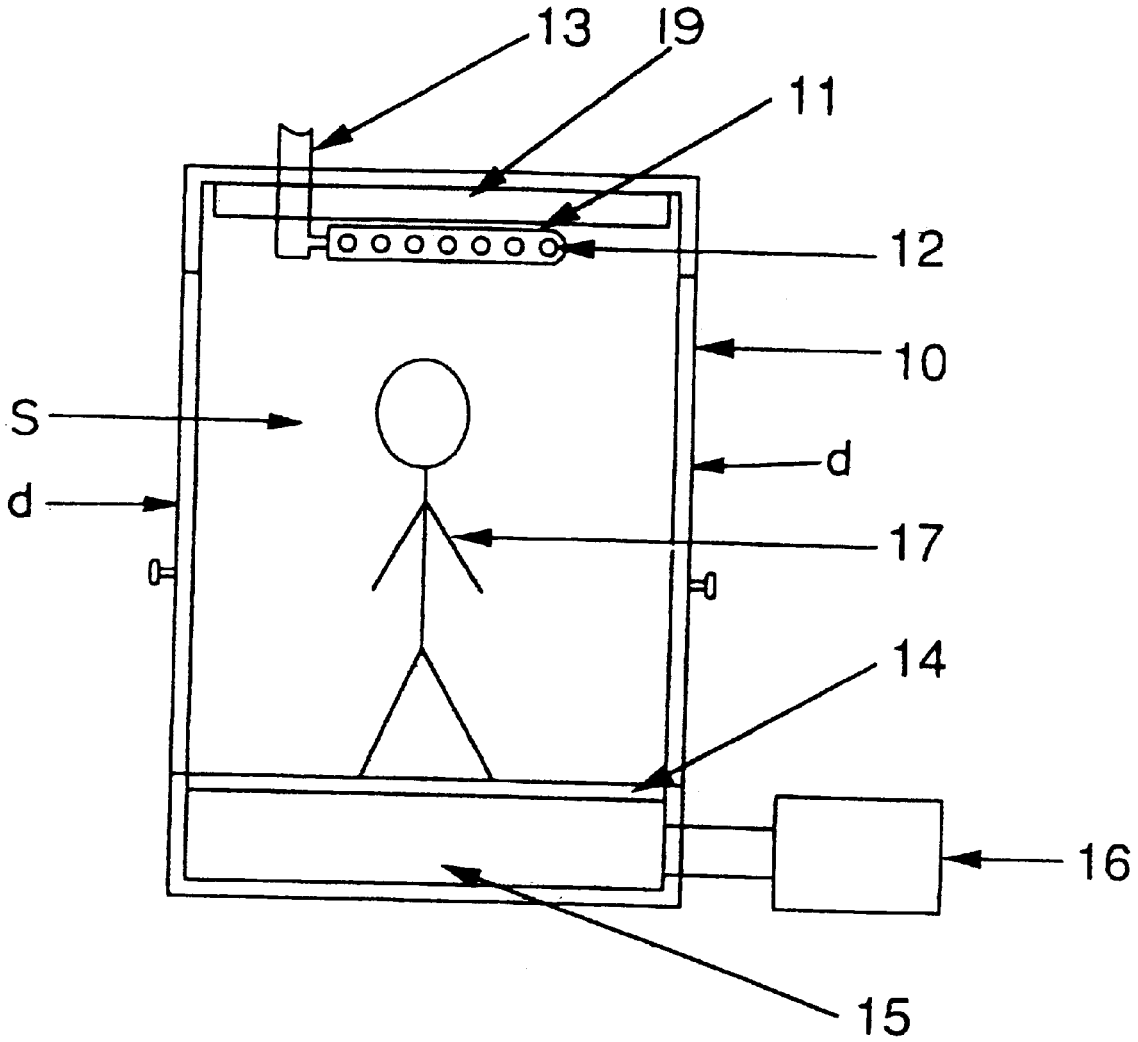
FIG. 5 is a cut-away view of an air shower apparatus relating to a second embodiment of the present invention.
Figure 6:
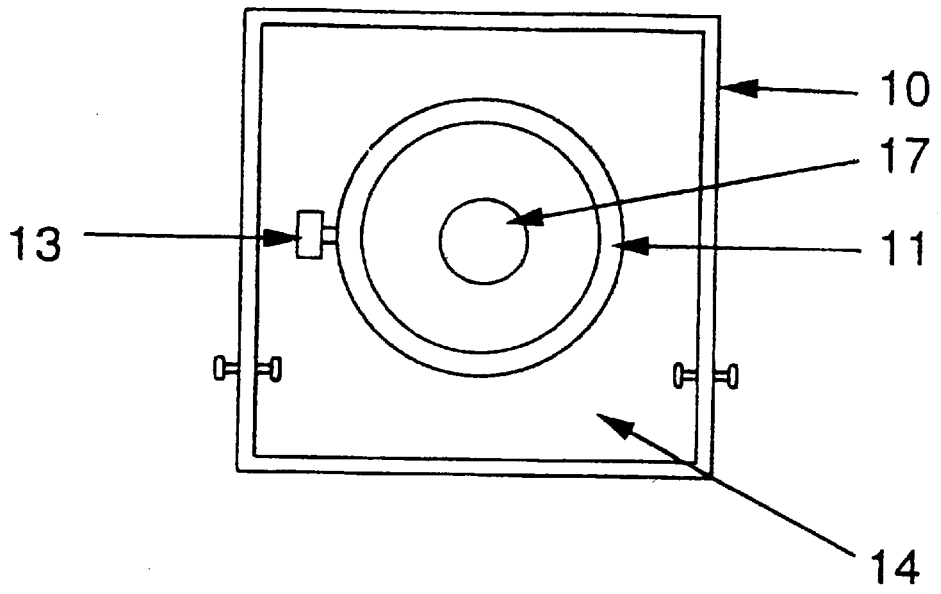
FIG. 6 is a plan view of the air shower apparatus relating to the second embodiment of the present invention.
Figure 7:
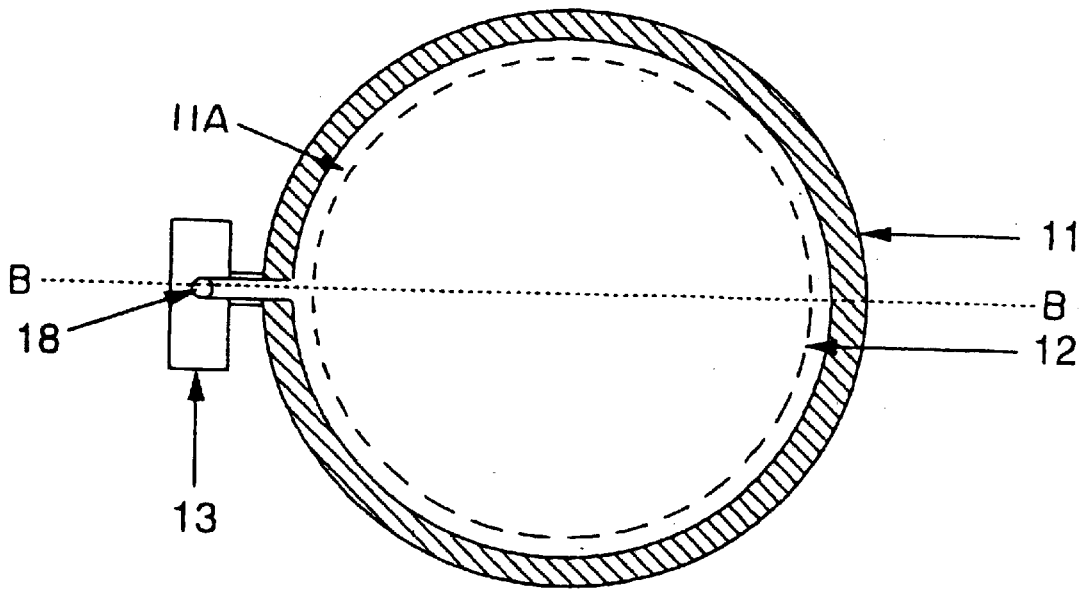
FIG. 7 is an enlarged view of a ring member relating to the second embodiment of the present invention.
Figure 8:
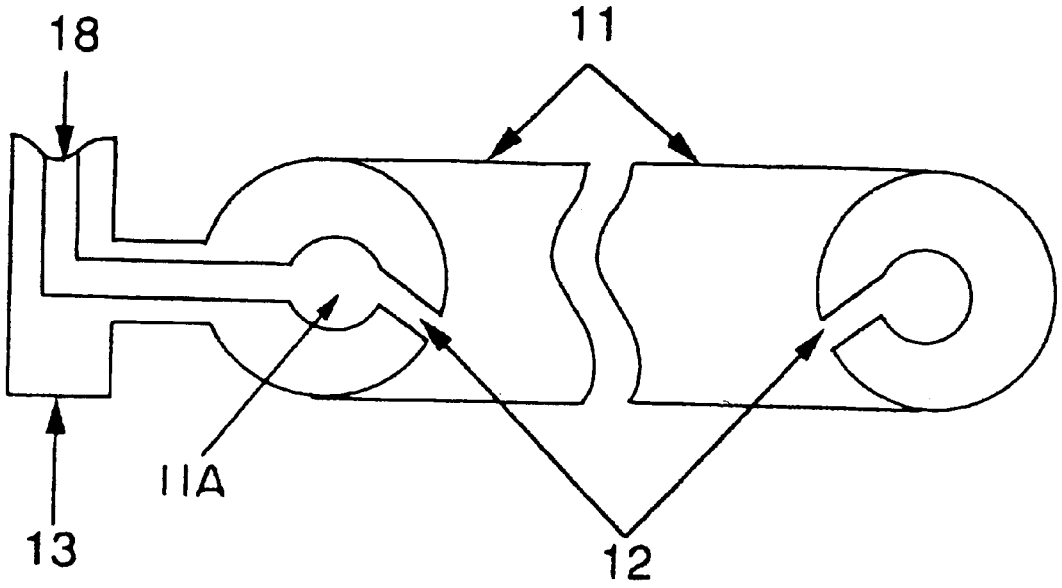
FIG. 8 is a cut-away view taken along line B—B of FIG. 7 showing a ring member relating to the second embodiment of the present invention.

FIG. 5 to FIG. 8 show a second embodiment of the present invention. FIG. 6 is a cut-away view of an air shower apparatus, FIG. 6 is a plan view of the air shower apparatus of FIG. 5, FIG. 7 is an enlarged view of a ring member and FIG. 8 is a cut-away view taken along line B—B of FIG. 7.

With the air shower apparatus of this embodiment also the air shower chamber S is formed within an air shower unit body 10, with a ring member 11 having a clean air path 11 A and air blowing outlets 12 being arranged at the ceiling side of the air shower chamber S. The ring member 11 is supported by a vertical drive shaft 13 capable of moving up and down within the air shower chamber S. An air supply path 18 is present within the ring member 11 and communicates with the clean air path 11A. The internal diameter of the ring member 11 is of a size capable of surrounding the periphery of a chamber entrant (body) 17.

A pre-filter 14 is arranged at the lower part of the air shower chamber S and an air expulsion buffer chamber 15 is provided below the pre-filter 14. An air expulsion unit 16 is connected to the air expulsion buffer chamber 15 and negative pressure is maintained at the air expulsion buffer chamber 15.

In the second embodiment, a plurality of air blowing outlets 12 are provided at intervals along the inner periphery of the ring member 11 as in the first embodiment but the second embodiment differs in that the air blowing outlets 12 are inclined so as to face downwards. Further, an air down flow unit 19 for blowing clean air downwards is provided at the ceiling portion of the air shower chamber S. This air down flow unit 19 is provided above the ring member 11.

By providing the air blowing outlets 12 so as to be inclined downwards in this way, the flow of clean air can be actively forced downwards. Horizontal convection of air can therefore be made small using this clean air flow and dust particles can be effectively prevented from becoming re-attached to the chamber entrant 17.

By specially arranging the air down flow unit 19 for blowing clean air in a downward direction at the ceiling of the air shower chamber S, the flow of air in the vertical direction can be more actively performed and the amount of disturbance to the air flow can be made small.

Third Embodiment

Figure 9:
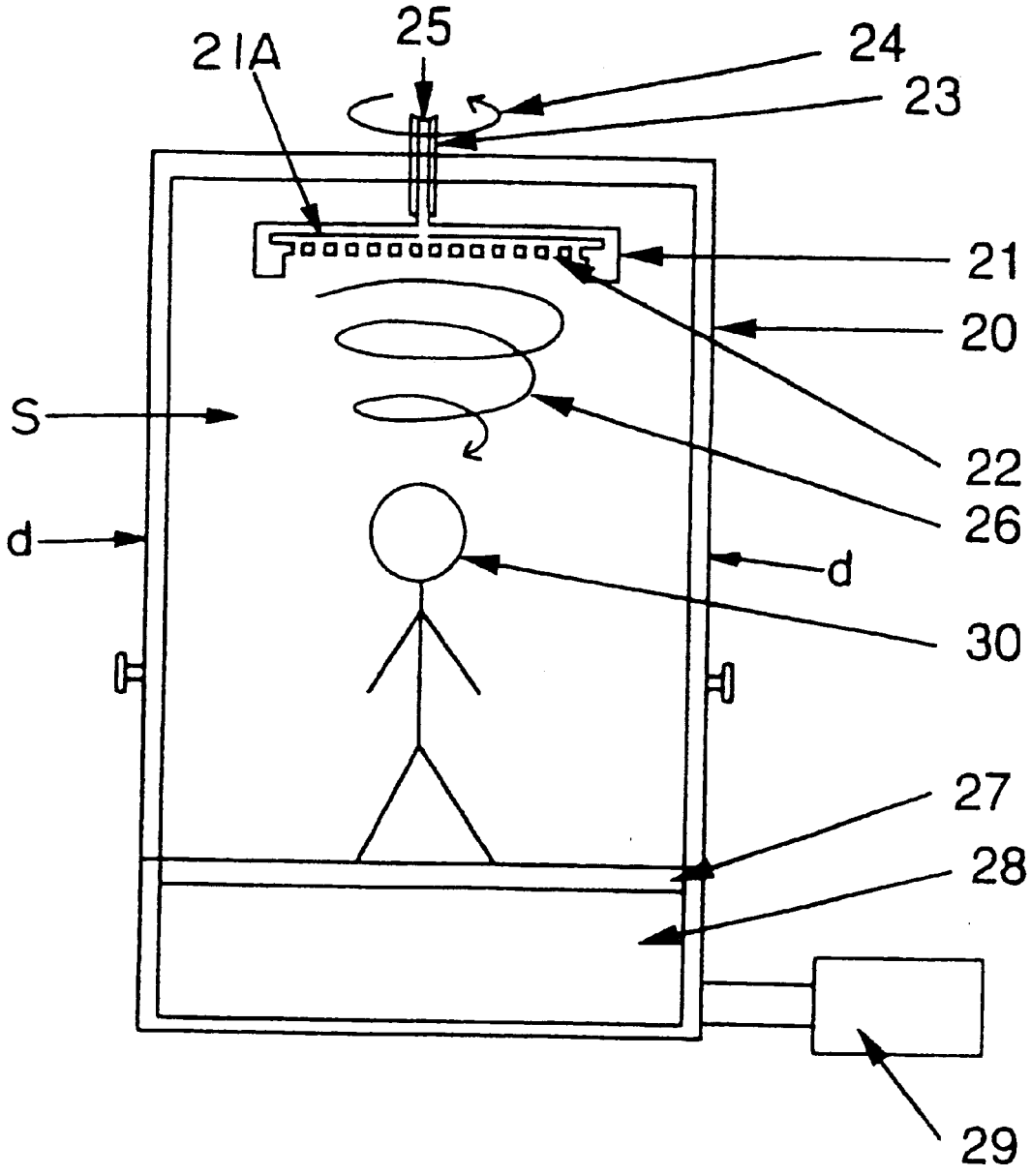
FIG. 9 is a cut-away view of an air shower apparatus relating to a third embodiment of the present invention.
Figure 10:
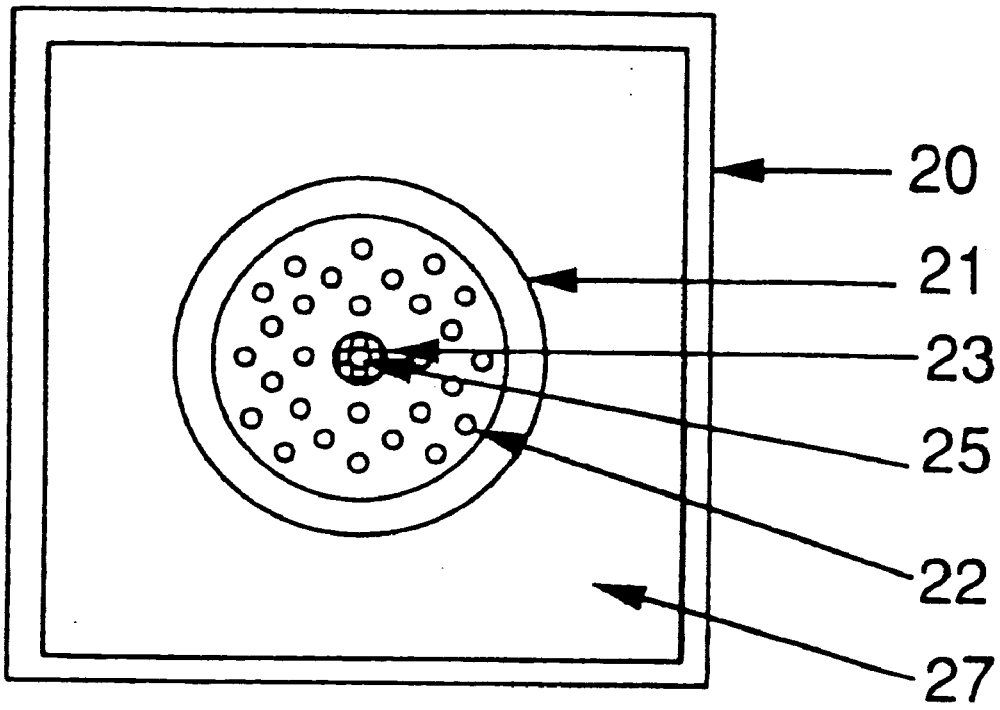
FIG. 10 is a plan view of an air shower apparatus relating to the third embodiment of the present invention.

FIG. 9 and FOG. 10 show a third embodiment of the present invention. FIG. 9 is a cut-away view of an air shower apparatus and FIG. 10 is a plan view of the air shower apparatus.

With the air shower apparatus relating to this embodiment also, the air shower chamber S is formed within an air shower unit body 20 and a ring member 21 having a plurality of air blowing outlets 22 are arranged at the ceiling of the air shower chamber S. A path 21A communicating with each air blowing outlet 22 is formed within the ring member 21. The ring member 21 is supported by a rotating shaft 23 and can be rotated at high speed within the air shower chamber S by a rotary drive unit (not shown).

An air supply path 25 communicating with the path 21A is present within the rotating shaft 23. The internal diameter of the ring member 21 is of a size capable of surrounding the periphery of a chamber entrant (body) 30. A pre-filter 27 is arranged at the lower part of the air shower chamber S and an air expulsion buffer chamber 28 is provided below the pre-filter 27. An air expulsion unit 29 is connected to the air expulsion buffer chamber 28 so that the air expulsion buffer chamber 28 is kept at negative pressure.

A major feature of this third embodiment is that rather than the ring member 21 moving vertically, the ring member 21 rotates at high speed in a direction of rotation 24. As a result, air blown out from each of the air blowing outlets 22 becomes a so-called spiral-shaped cyclone. The speed of rotation is set to be, for example, approximately 500 to 5000 rpm.

Air maintaining cyclone energy due to the high-speed rotation is then blown so as to surround the chamber entrant 30 from head to toe. At the same time, air contaminated with dust particles removed from the chamber entrants' clothing etc. passes through the pre-filter 27 for trapping the dust particles, flows to the air expulsion buffer chamber 28 and is expelled to outside by the air expulsion unit 29.

According to this embodiment, the ring member 21 is made to rotate and by ensuring that the air is given cyclone energy, the air envelops the chamber entrant so as to strike the chamber entrant completely and dust particles attached to the clothes etc. of the chamber entrant can be removed in an effective manner. A configuration where the ring member 21 moves vertically as opposed to rotating is also possible.

Fourth Embodiment

Figure 11:
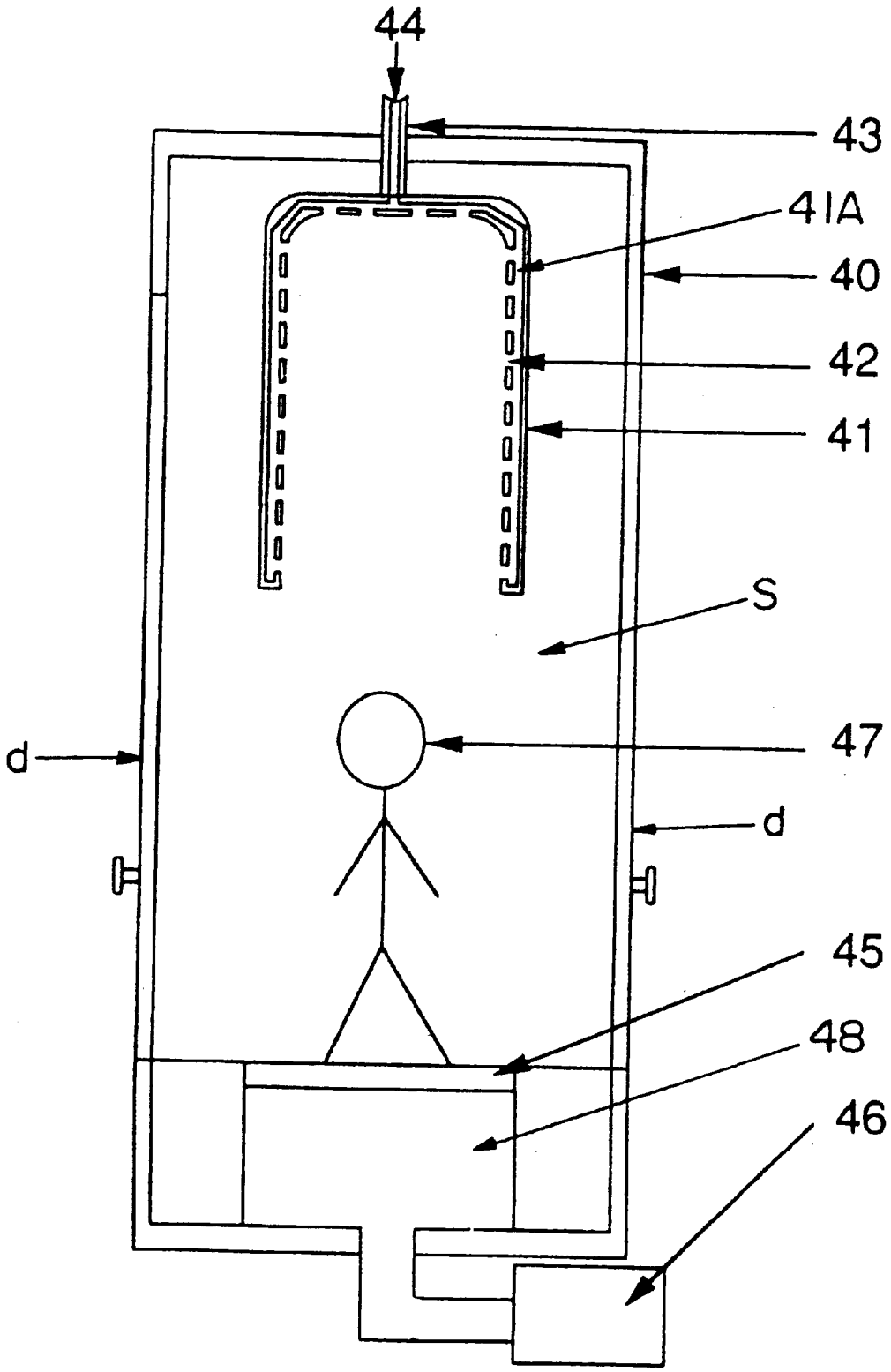
FIG. 11 is a cut-away view of an air shower apparatus of a fourth embodiment of the present invention.
Figure 12:
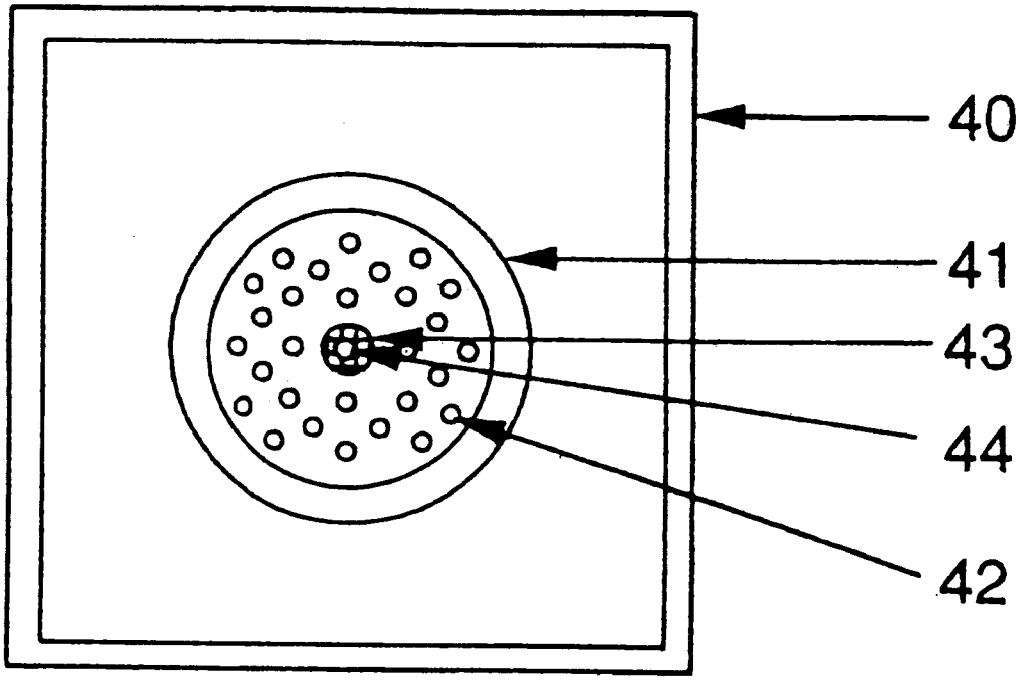
FIG. 12 is a plan view of an air shower apparatus relating to the fourth embodiment of the present invention.

FIG. 11 and FIG. 12 show a fourth embodiment of the present invention. FIG. 11 is a cut-away view of an air shower apparatus and FIG. 12 is a plan view of the air shower apparatus of FIG. 11.

With the air shower apparatus of this embodiment, the air shower chamber S is formed within an air shower unit body 40 and a dome member 41 having a plurality of air blowing outlets 42 is arranged at the ceiling of the dome member 42. This dome member 41 has a path 41A therein communicating with each of the air blowing outlets 42. The dome member 41 is supported at a vertically moving shaft 43 and moves the dome member 41 up and down using a drive unit (not shown).

An air supply path 44 is present within the vertically moving shaft 43 and communicates with the path 41A. The internal diameter of the dome member 41 is of a size capable of surrounding the periphery of a chamber entrant (body) 47. The height of the ceiling of the dome member 41 is made higher than the height of the chamber entrant 47 and is 2m in this embodiment. The dome member 41 can therefore completely cover the chamber entrant 47.

A pre-filter 45 is arranged at the lower part of the air shower chamber S and an air expulsion buffer chamber 48 is provided below the pre-filter 45. An air expulsion unit 46 is connected to the air expulsion buffer chamber 48 and the air expulsion buffer chamber 48 is maintained at negative pressure. The pre-filter 45 is provided in such a manner as to fit within the range encompassed by (i.e. have the same diameter or less than) the open lower end of the dome member 41 with the dome member 41 lowered so as to be positioned on the pre-filter 45. Specifically, the plane surface area of the pre-filter 45 is designed and manufactured so as to be smaller than or equal to the open end of the dome member 41. Air within the dome member 41 therefore passes directly through to the pre-filter 45 and the air expulsion buffer chamber 48 for discharging without leaking from within the air shower chamber S.

Therefore, if this point is achieved, the plane shape and size of the pre-filter 45 is not influenced. For example, the air expulsion outlet to the pre-filter 45 can be formed in a grating shape etc. and be designed in such a manner as to be encompassed by the open lower end of the dome member 41.

According to this embodiment, when a person enters the air shower chamber S and stands at a prescribed position (on the grating region of the pre-filter 45), the dome member 41 is lowered downwards by the vertically moving shaft 43 so that the chamber entrant 47 is covered. Clean air is then blown out at high-speed from the air blowing outlets 42 of the dome member 41. At the same time, air contaminated with dust particles removed from the clothes etc. of the chamber entrant 47 passes through the pre-filter 45 in order to trap dust particles, flows to the air expulsion buffer chamber 48 and is expelled to outside by the air expulsion unit 46.

At this time, part of the pre-filter 45 for carrying out this air expulsion (the part below the floor) is of the same diameter or less as the open lower end of the dome member 41 and the open lower end is positioned so as to closely touch the top of the pre-filter 45. Air within the dome member 41 is therefore forcibly expelled in a smooth manner without turbulence occurring in the flow of air. Leaking of contaminated air to outside and reattaching of dust particles can therefore be effectively prevented.

Fifth Embodiment

Figure 13:
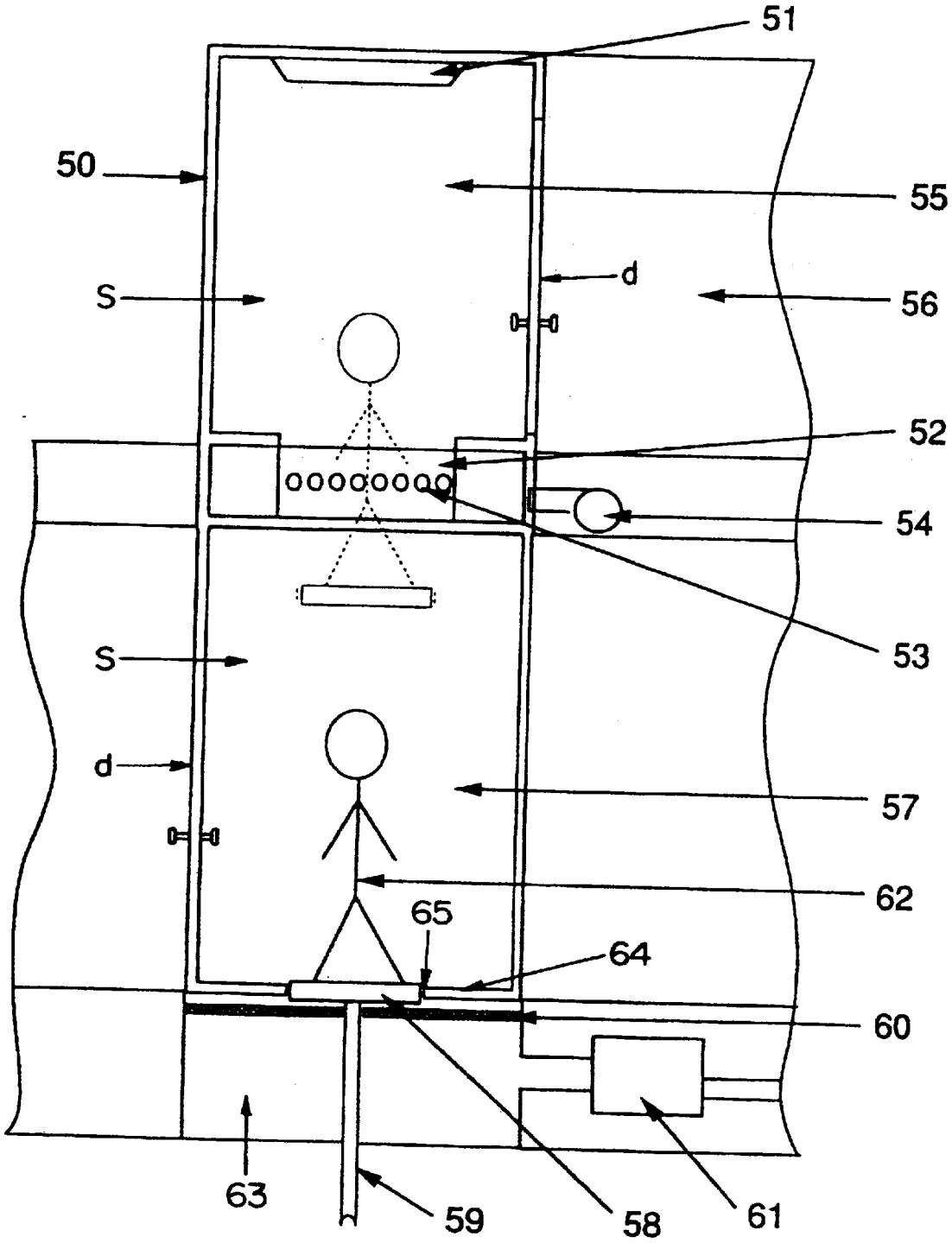
FIG. 13 is a cut-away view of an air shower apparatus relating to a fifth embodiment of the present invention.
Figure 14:
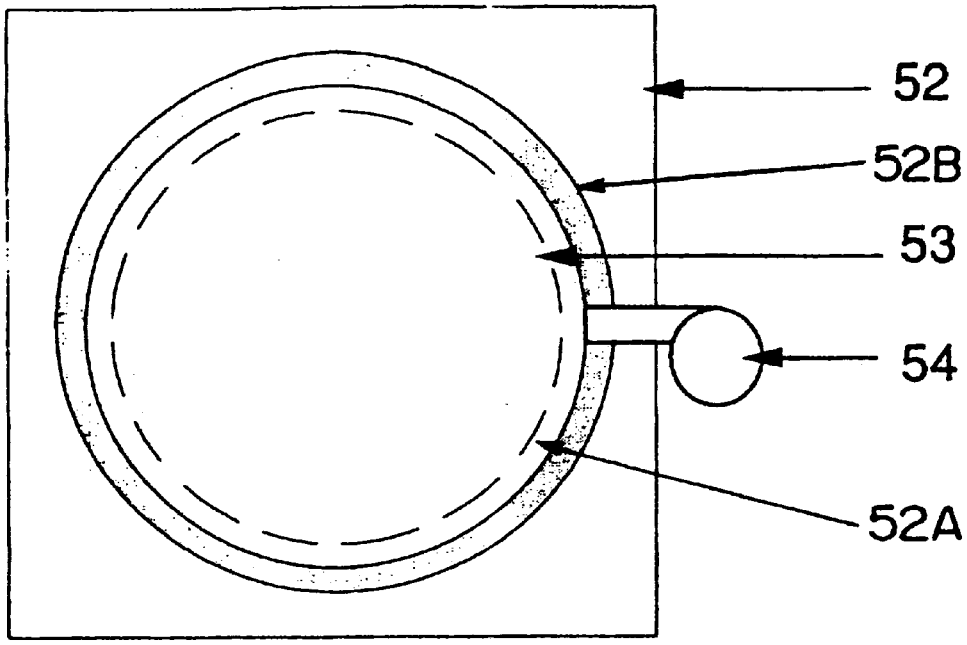
FIG. 14 is a plan view of a blower unit relating to the fifth embodiment of the present invention.
Figure 15:
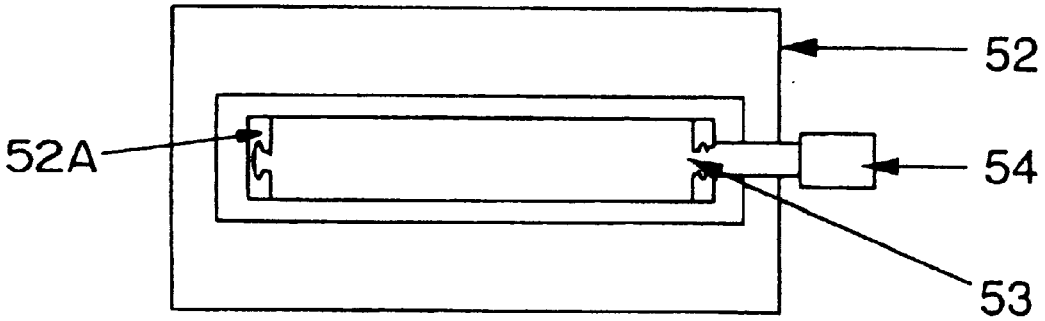
FIG. 15 is a cut-away view of a blower unit relating to the fifth embodiment of the present invention.

FIG. 13 to FIG. 15 show a fifth embodiment of the present invention. FIG. 13 is a cut-away view of an air shower apparatus. FIG. 14 is a plan view of a blowing unit. FIG. 15 is a cut-away view of the blowing unit.

In this fifth embodiment, the air shower chamber S within a lengthened air shower unit body 50 is divided into a negative pressure chamber 57 and a positive pressure chamber 55 arranged one on top of the other. Vertical raising means including an elevator (table) 58 and an elevator shaft 59 for moving the elevator 58 up and down using a drive unit (not shown) is provided at the lower negative pressure chamber 57. A pre-filter 60, air expulsion buffer chamber 63 and air expulsion unit 61 are arranged under the floor of the negative pressure chamber 57.

The surface of the elevator 58 is positioned within an opening 65 at a floor 64 in such a manner as to usually be at approximately the same level as the floor surface of the negative pressure chamber 57. This opening 65 also functions as an air expulsion outlet to the pre-filter 60. A required portion of the floor is made from a grating etc. in order to take into consideration the discharge of air. The elevator shaft 59 extends downwards so as to pass through the pre-filter 60.

On the other hand, a clean air blowing unit 52 is arranged at the positive pressure chamber 55 in the vicinity of the floor of the positive pressure chamber 55. As shown in FIG. 14 and FIG. 15, the blowing unit 52 is equipped with a clean air path 52A, a ring member 52B having a plurality of air blowing outlets 53 communicating with the clean air path 52A, and a turbo fan 54. Each air blowing outlet 53 blows air in the direction of a chamber entrant 62 on the elevator 58. The ring member 52B is made of a size at least capable of encompassing the periphery of the chamber entrant 62.

Numeral 51 represents an air down flow unit arranged on the ceiling side of the positive pressure chamber 55 and blows out clean air as a down flow. Numeral 56 shows a clean room with the door d.

In this embodiment, when the chamber entrant 62 stands on the elevator 58 within the negative pressure chamber 57, the elevator 58 moves up due to the operation of the elevator shaft 59. At the same time, air sent by the turbo fan 54 is blown out from the air blowing outlets 53 so as to be blown onto the chamber entrant 62. The chamber entrant 62 is therefore blown onto from head to toe while passing through the blowing unit 52 on the elevator 58.

On the other hand, clean air is usually made to flow downwards as a down flow via the air down flow unit 51 arranged at the ceiling, within the positive pressure chamber 55. The air flow due to this air then flows to the negative pressure chamber 57. Air flowing to the negative pressure chamber 57 is expelled to outside by the usually operating air expulsion unit 61 via the pre-filter 60. When this series of operations finishes, the chamber entrant 62 opens the door d and moves into a clean room 56.

According to this embodiment, the air shower chamber S is divided into the positive pressure chamber 55 and the negative pressure chamber 57, the clean air blowing unit 52 is interposed therebetween, and usual down flow and air expulsion is adopted. As a result, there is little disturbance to the air flow and dust particles can be prevented from becoming re-attached. Further, configuration of an air shower apparatus having a small surface area that is advantageous with respect to floor space can be achieved by a two-stage elongated configuration.

According to the present invention, the efficiency of removing dust particles can be raised, re-attachment of dust particles can be prevented and the leaking of air mixed with dust particles into a clean room can be prevented and superior results that could not be obtained in the related art can be obtained.

What is claimed is:

1. An air shower apparatus comprising:

an air shower room;

a ring member provided within the air shower room and having a plurality of air blowing outlets for blowing clean air in a direction of a chamber entrant to remove dust particles, the plurality of air blowing outlets being arranged at prescribed intervals along the inner periphery surface of the ring member in such a manner as to surround the chamber entrant; and a vertical drive unit for moving the ring member up and down in such a manner that clean air is blown towards the chamber entrant from head to toe.

2. The apparatus of claim 1, wherein the plurality of air blowing outlets provided for the ring member face downwards at an incline.

3. The apparatus of claim 1, further comprising a down flow unit, provided above the ring member, for blowing clean air downwards.

4. The apparatus of claim 1, further comprising a rotary drive unit for rotating the ring member.

5. The apparatus of claim 1, further comprising an air expulsion unit provided at an air expulsion buffer room provided below the air shower room, for keeping the air expulsion buffer room at negative pressure with respect to the air shower room.

6. The apparatus of claim 4, wherein the rotational speed of the rotary drive unit rotating the ring member is 500 to 5000 rpm.

7. A semiconductor wafer processing method comprising:

removing dust particles from the semiconductor wafer by an air shower apparatus of claim 1;

processing the semiconductor wafer in a clean room.

* * * * *